US012497202B1

(12) United States Patent
Quinones

(10) Patent No.: US 12,497,202 B1
(45) Date of Patent: Dec. 16, 2025

(54) RING PACKAGER AND METHOD OF USE THEREOF FOR PACKAGING COILED MATERIAL

(71) Applicant: Victor M. Quinones, San Antonio, TX (US)

(72) Inventor: Victor M. Quinones, San Antonio, TX (US)

( * ) Notice: Subject to any disclaimer, the term of this patent is extended or adjusted under 35 U.S.C. 154(b) by 0 days.

(21) Appl. No.: 19/230,794

(22) Filed: Jun. 6, 2025

(51) Int. Cl.
*B65B 11/08* (2006.01)
*B65B 25/14* (2006.01)

(52) U.S. Cl.
CPC ..... *B65B 25/146* (2013.01); *B65B 11/08* (2013.01)

(58) Field of Classification Search
USPC ..... 53/459
See application file for complete search history.

(56) References Cited

U.S. PATENT DOCUMENTS 2,668,402 A 2/1954 Whytlaw
8,042,460 B2 10/2011 Song
10,370,131 B2 8/2019 Quinones
2006/0201110 A1 9/2006 Quinones
2015/0251785 A1 9/2015 Canini et al.
2017/0174372 A1* 6/2017 Quinones ..... B65B 11/004
2019/0118985 A1* 4/2019 Graham ..... B65B 51/043

FOREIGN PATENT DOCUMENTS

CN 216806132 U 6/2022
TW M655083 U * 5/2024

* cited by examiner

*Primary Examiner* — Chinyere J Rushing-Tucker
(74) *Attorney, Agent, or Firm* — Nath, Goldberg & Meyer; Joshua B. Goldberg

(57) ABSTRACT

A ring holder for packaging coiled materials and method of use thereof are provided. The ring holder is configured to secure packaging thereon and is supported on a front trolley and packaging trolley line for movement over a coiled material. The ring holder is pivotable on the front trolley between a stowed and active position. A packaging tail gripper is mounted on a rear trolley and follows the front trolley on the packaging trolley line. The tail gripper is configured for rotation and twisting a tail of the packaging prior to suctioning the tail through a core of the coiled material. A packaging dispenser is provided for dispensing packaging onto the ring holder. The tail gripper may be seated within the packaging dispenser. The ring holder allows for packaging to be secured quickly and efficiently relative to the cumbersome process of manually placing packaging over coiled materials.

20 Claims, 9 Drawing Sheets

RING PACKAGER AND METHOD OF USE THEREOF FOR PACKAGING COILED MATERIAL

BACKGROUND OF THE INVENTION

Field of the Invention

The present disclosure relates generally to the packaging and wrapping industries, and particularly to a ring holder apparatus and method of use thereof for packaging coiled materials, such as steel coils and the like.

Description of Related Art

Many materials, e.g., steel of various alloys and other metals, plastics, etc., are often processed into coils or rolls during manufacture in order to provide compact storage and convenient dispensing for use. Such coils of sheet material nearly universally require some form of external protection from the time they are coiled to the time when the material is dispensed from the coil. In the case of metals, some form of external packaging is used primarily to protect the material from corrosion, while also serving to protect the exterior layer of material from physical damage, at least to some extent.

Accordingly, various forms of external packaging for coiled materials have been developed in the past. One general method is described in U.S. Pat. No. 10,370,131 B2, commonly owned by the present applicant and herein incorporated by reference (hereinafter referred to as, the '131 patent). In the '131 patent, an apparatus and method for packaging coiled materials is provided using a vacuum to draw the free end of a packaging sleeve through an open core of coiled material. A trolley lifts the coiled material to align its open core with a hollow mandrel and passes the coiled material over the mandrel. The trolley is lowered to expose the coil circumference for packaging. In order to place the packaging over the coiled material, one or more workers place a large piece of packaging over the coil. This step can be difficult for workers of average or small stature, due to the large size of the coil, which are sometimes over five or six feet in diameter and can weigh multiple tons. A worker of average or small size, and even tall workers in many cases, require one or more additional personnel to help with placement of the packaging over the coil, making this step cumbersome and inefficient from a productivity standpoint.

Thus, a ring holder and method of use thereof for packaging coiled materials solving the aforementioned problems is desired.

SUMMARY OF THE INVENTION

A method and a system of using a ring holder for packaging coiled materials are provided by the present disclosure. The method includes pivoting the ring holder from a stowed position into an active position. The ring holder is supported by a front trolley on a packaging trolley line and the ring holder is configured for securing packaging thereon. With the packaging secured on the ring holder, the front trolley, ring holder, and packaging are moved forward on the packaging trolley line thereby moving the ring holder and packaging over a coiled material in order to cover the coiled material with the packaging. The ring holder allows for packaging to be secured onto the coiled material quickly and efficiently relative to the cumbersome process of multiple workers manually placing the packaging over the entire coiled material.

The present method of packaging coiled materials may include securing a tail end of the packaging using a tail gripper, wherein the tail gripper is positioned on a rear trolley and configured to follow the front trolley on the packaging trolley line. The tail end of the packaging may be rotated using the tail gripper to place the tail end of the packaging into a twisted configuration. Once the tail end of the packaging is in a twisted configuration, suction may be applied to the tail end of the packaging through a center opening of the coiled material using a vacuum. While suction is applied, the tail gripper releases the tail end of the packaging such that the packaging is suctioned through a center opening of the coiled material.

In an embodiment, the method for packaging coiled materials includes placing the packaging onto the ring holder while the ring holder is in the stowed position. The packaging may be dispensed from a packaging dispenser and fed out from a roll of packaging. The packaging may be cut manually or automatically to separate and dispense a portion of packaging, from the roll of packaging, onto the ring holder.

In an embodiment, the portion of packaging is separated and dispensed onto the ring holder while the ring holder is in the stowed position. The packaging may be dispensed onto the ring holder while the ring holder is in a rearward position on the packaging trolley line. The packaging may be dispensed over a rear trolley and tail gripper seated within a seat formed in the packaging dispenser. The tail gripper grips a tail end of the portion of packaging after the portion of packaging is cut and dispensed onto the ring holder. The tail gripper may grip the tail end of the packaging while seated within the packaging dispenser.

In an embodiment, the ring holder may be vertically oriented in the stowed position and vertically oriented in the active position. In another embodiment, the ring holder may be substantially horizontal, i.e. oriented at an angle less than 45° from horizontal, in the stowed position, and may be vertical in the active position.

The method for packaging coiled materials may further include releasing the packaging from the ring holder when the ring holder is in a forward position, past the coiled material on the packaging trolley line. The packaging may be released from the ring holder manually or automatically, after which the ring holder may be retracted backwards along the packaging trolley line over the coiled material.

Further provided by the present disclosure is a system for packaging coiled materials. The system includes a ring holder configured to securely hold packaging for coiled material on a circumference of the ring holder. The ring holder is mounted on a front trolley and pivotable thereon between a stowed position and an active position. A tail gripper is included and configured to grip a tail end of the packaging. The tail gripper is positioned on a rear trolley configured to follow the front trolley on a packaging trolley line.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1A:
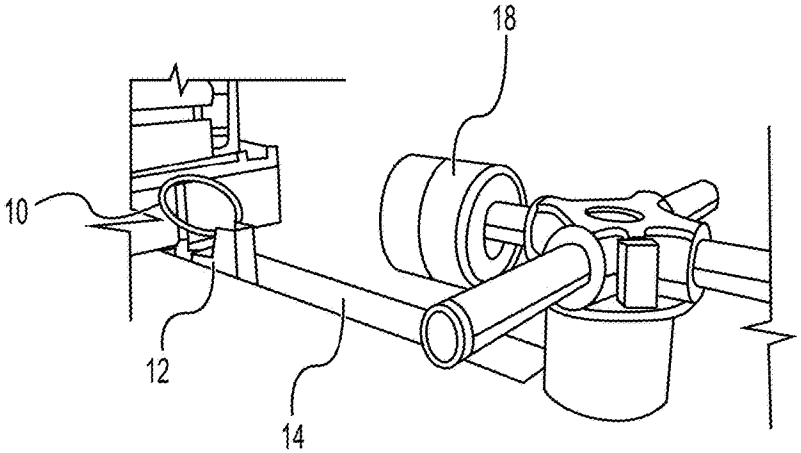
FIG. 1A is an environmental perspective view of a ring holder for packaging material where the ring holder is in a horizontally stowed position on a packaging trolley line.
Figure 1B:
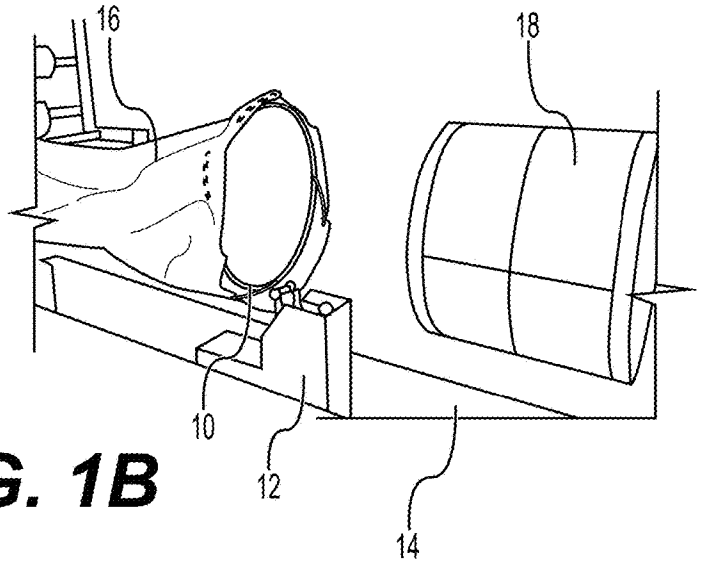
FIG. 1B is an environmental perspective view of a ring holder in a vertical, active position.
Figure 1C:
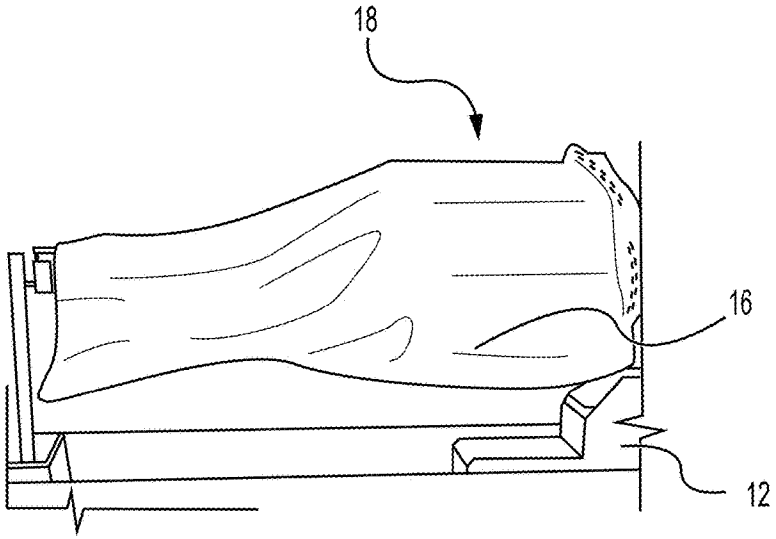
FIG. 1C is an environmental perspective view of packaging covering a coiled material using the ring holder.

Referring to FIGS. 1A-C, a system for packaging coiled materials 18 and a method of using a ring holder 10 to do so are provided by the present disclosure. The method includes pivoting the ring holder 10 from a stowed position shown in FIG. 1A into an active position, shown in FIG. 1B. The ring holder 10 is supported by a front trolley 12 on a packaging trolley line 14 and the ring holder 10 is configured for securing packaging 16 thereon. With the packaging secured to the ring holder 10 (details of the ring holder 10 and securing the packaging thereto are discussed further below with respect to FIGS. 6A-D), the front trolley 12, ring holder 10, and packaging 16 are moved forward on the packaging trolley line 14, thereby moving the ring holder 10 and packaging 16 over a coiled material 18, thus covering the coiled material 18 with the packaging 16. The ring holder 10 allows for packaging 16 to be secured onto the ring holder, followed by moving the packaging over the coiled material in a quick and efficient manner relative to the cumbersome process of manually placing packaging over the entire coil of material 18.

Figure 2A:
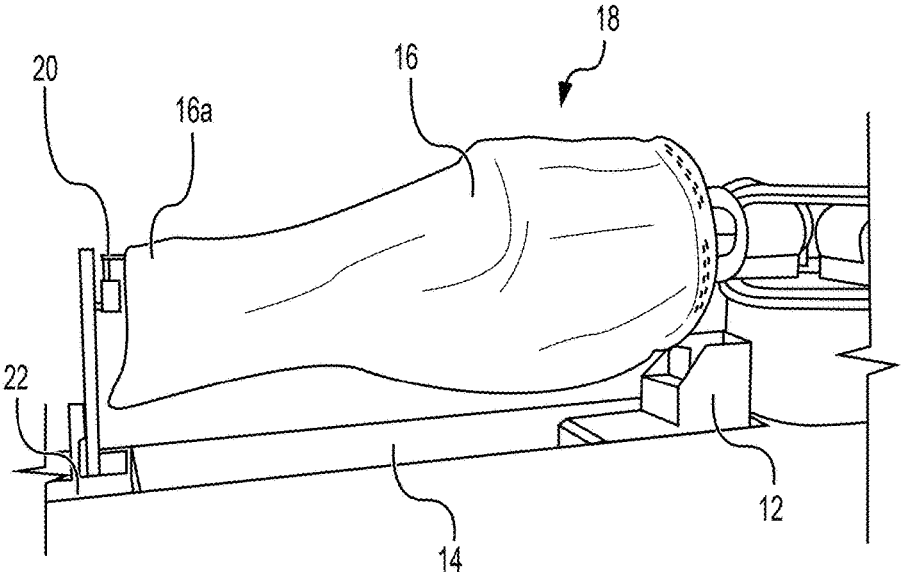
FIG. 2A is an environmental perspective view of suction being applied to packaging on a coiled material.
Figure 2B:
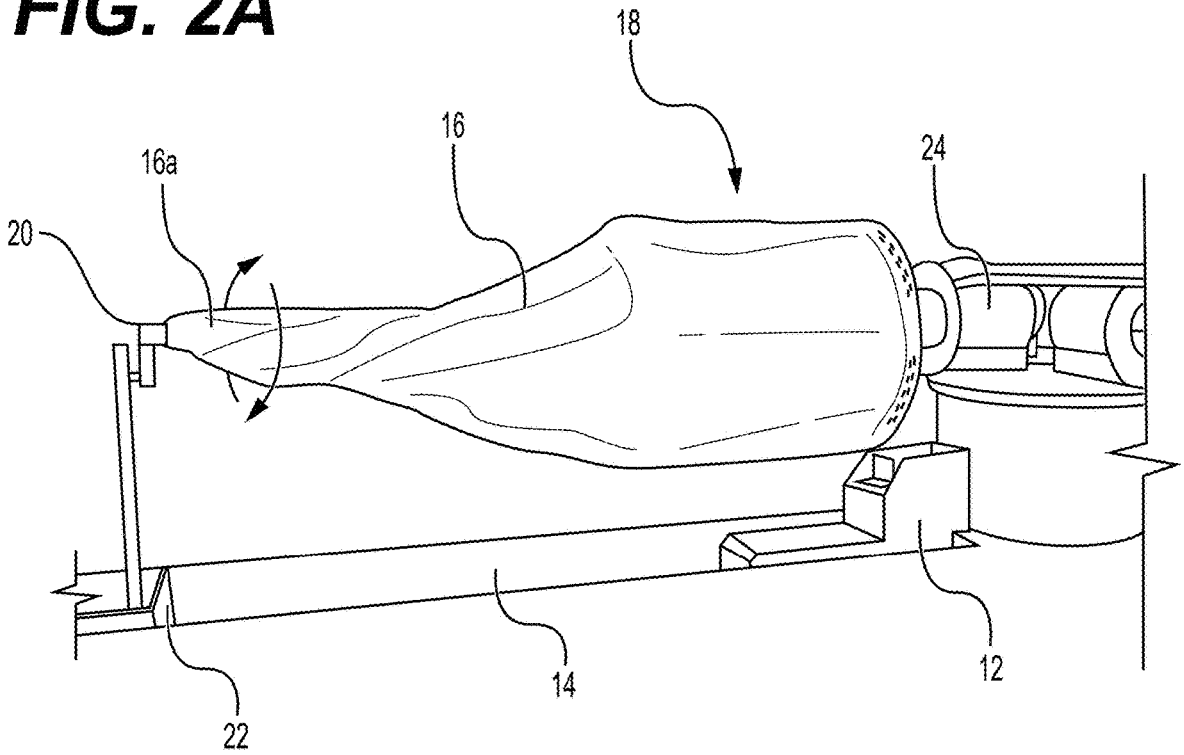
FIG. 2B is an environmental perspective view of a tail gripper rotating a tailed end of packaging into a twisted configuration.
Figure 2C:
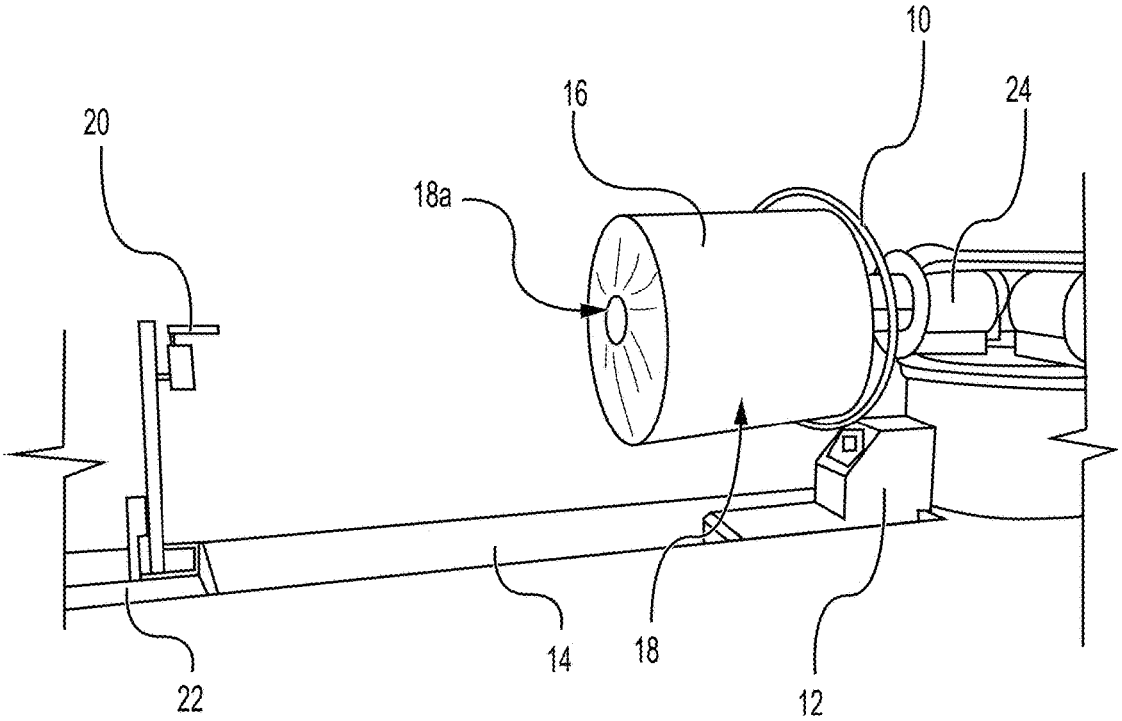
FIG. 2C is an environmental perspective view of a tail end of packaging having been suctioned through an open core of coiled material.

Turning to FIGS. 2A-D, the present method of packaging coiled materials may include securing a tail end of the packaging using a tail gripper 20, wherein the tail gripper 20 is positioned on a rear trolley 22 and configured to follow the front trolley 12 on the packaging trolley line 14. The tail end 16*a* of the packaging 16 may be rotated using the tail gripper 20 to place the tail end 16*a* of the packaging 16 into a twisted configuration, as shown in FIG. 2B. Once the tail end 16*a* of the packaging is in a twisted configuration, suction may be applied to the tail end of the packaging through a center opening 18*a* (see FIG. 2C) of the coiled material 18 using a vacuum 24, as shown in FIGS. 2B-C. In a non-limiting embodiment, the coiled material 18 may be held in a raised position using a hollow mandrel, with suction being applied by a vacuum through the hollow mandrel, as is taught in U.S. Pat. No. 10,370,131 B2 to the present applicant.

Figure 2D:
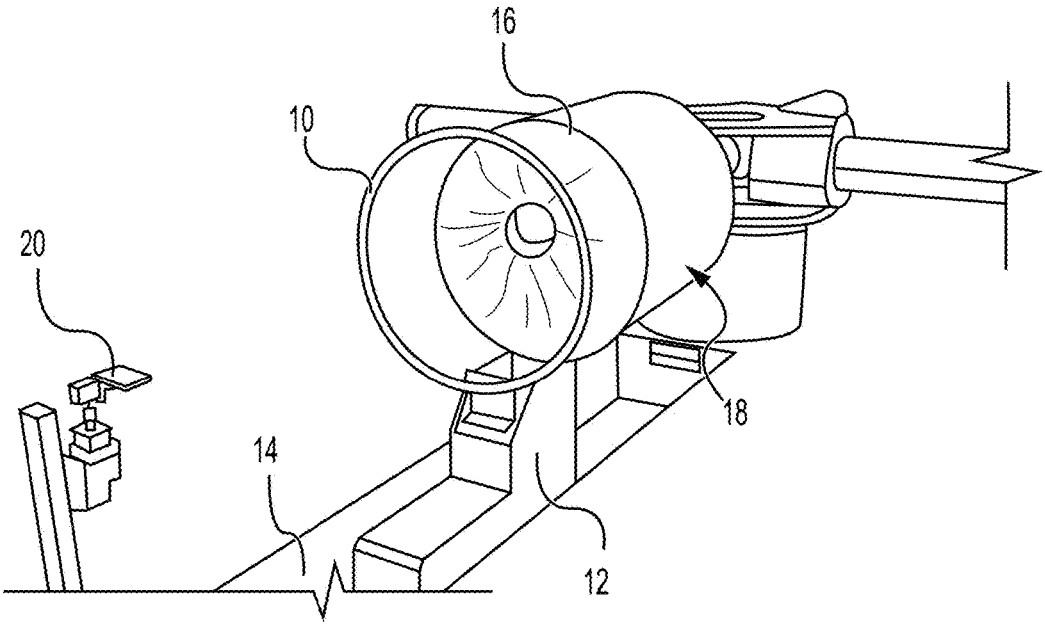
FIG. 2D is an environmental perspective view of a ring holder retracting over a packaged coiled material.

While suction is applied to the packaging, the tail gripper releases the tail end of the packaging such that the packaging is suctioned through the center opening 18*a* of the coiled material, as shown in FIG. 2C. The method for packaging coiled materials may further include releasing the packaging 16 from the ring holder 10 when the ring holder is in a forward position, past the coiled material on the packaging trolley line, whereafter the packaging, at a forward end of the coiled material, may be secured, for example, by a worker. The packaging may be released from the ring holder 10 manually or automatically, after which the ring holder may be retracted, as shown in FIG. 2D, in a reverse direction along the packaging trolley line 14 over the coiled material 18.

Figure 3A:
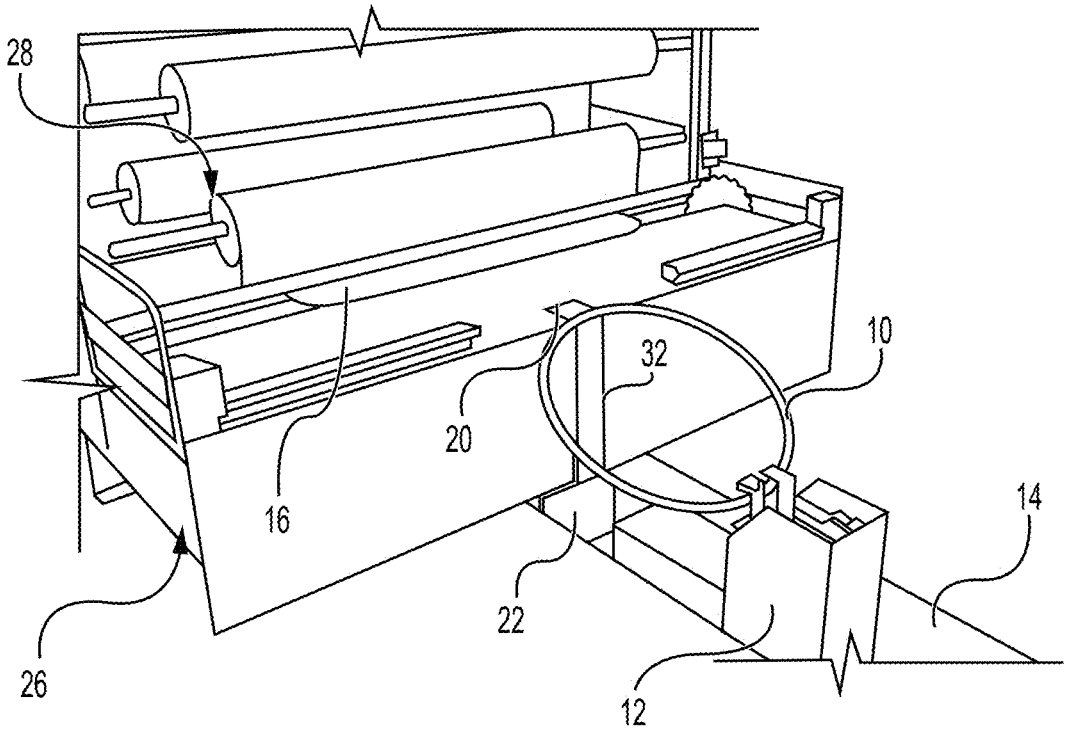
FIG. 3A is an environmental perspective view of a ring holder in a horizontal stowed position and a tail gripper seated within a packaging dispenser.
Figure 3B:
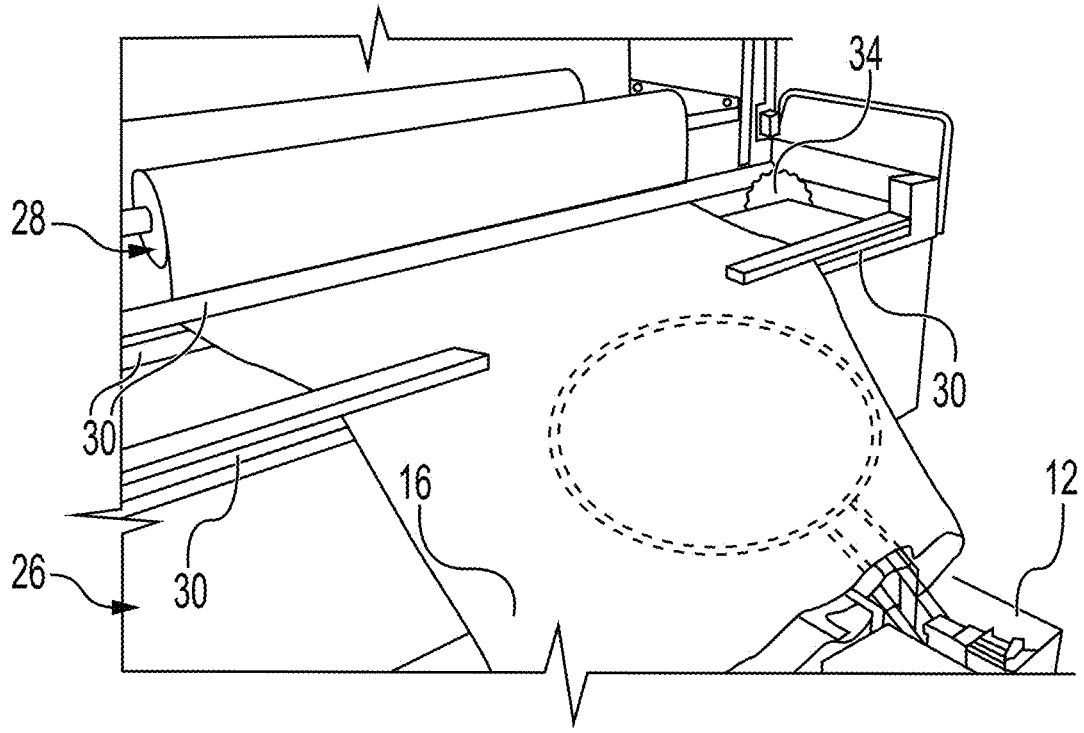
FIG. 3B is an environmental perspective view of packaging being dispensed onto a horizontally stowed ring holder.
Figure 3C:
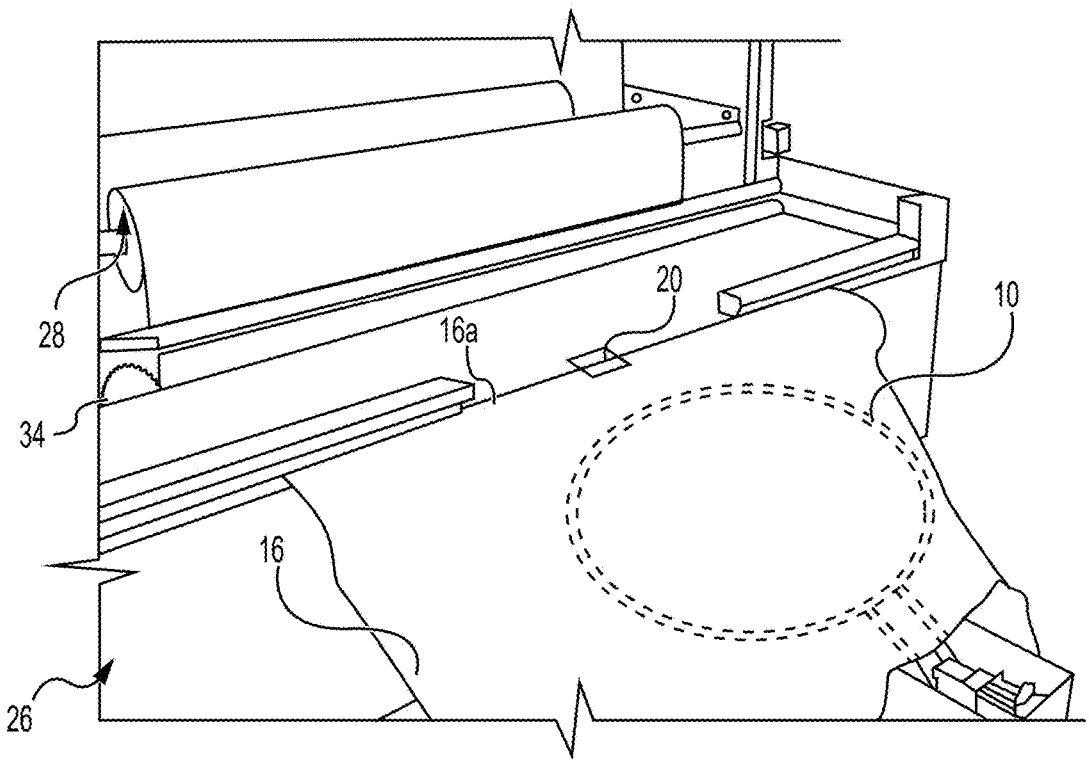
FIG. 3C is an environmental perspective view of a tail gripper gripping a tail end of packaging after the packaging has been cut by a cutter.
Figure 3D:
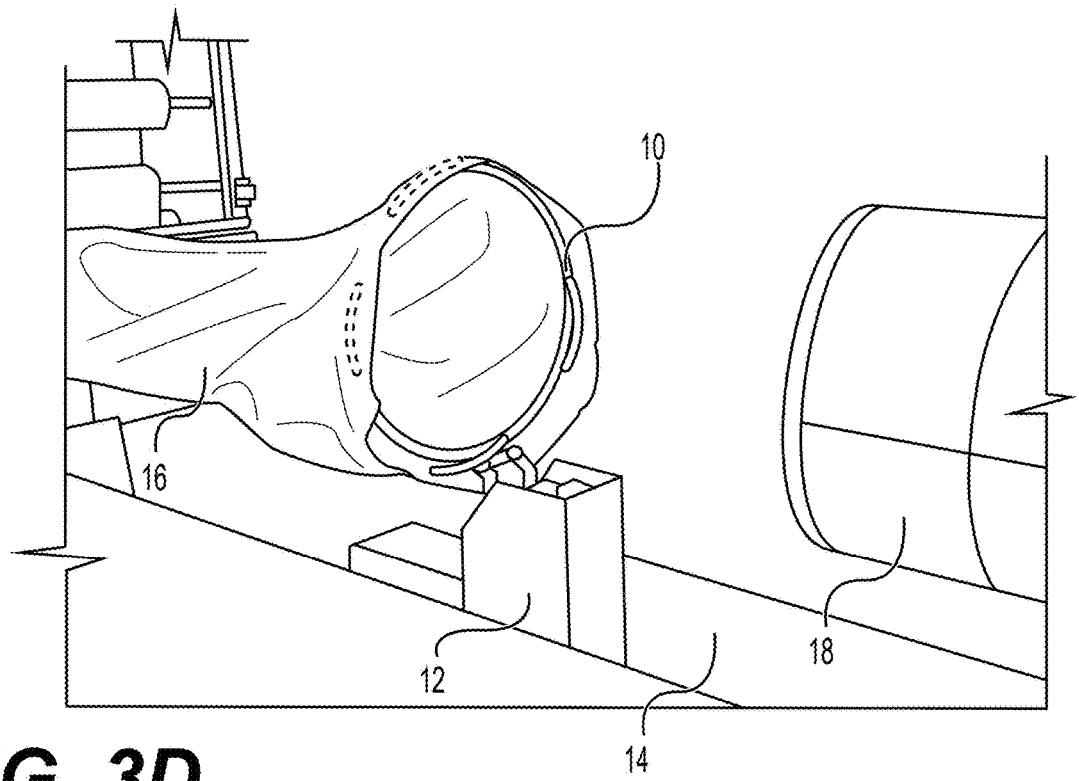
FIG. 3D is an environmental perspective view of a ring holder which is pivoted into a vertical, active position.

Referring to FIGS. 3A-D, in a non-limiting embodiment, the method for packaging coiled materials may include placing the packaging 16 onto the ring holder while the ring holder is in the stowed position and situated in a rearward position on the packaging trolley line 14. The packaging 16 may be dispensed over the rear trolley 22 and tail gripper 20, which are seated within a seat 32, seat 32 being in the form of a cutout formed in the packaging dispenser 16, as a non-limiting example. As shown in the embodiment of FIGS. 3A-D, the ring holder 10 is substantially horizontal in the stowed position. The terms "horizontal" or "substantially horizontal", as used herein, indicate that the ring holder is oriented at an angle below 45° with respect to the horizontal. Likewise, "vertical" or "substantially vertical" with reference to the ring holder indicates the ring holder is oriented at an angle greater than 45° with respect to the horizontal. The packaging may be dispensed from a packaging dispenser 26 and fed out from a roll 28 of packaging 16. The packaging may be manually dispensed by a worker from roll 28 or automatically dispensed by rollers 30, which may be motorized, as shown in FIG. 3B. Likewise, the packaging may be cut manually by a worker or automatically with a motorized cutter 34. After being cut, the packaging is now separated from the roll 28 and dispensed onto the ring holder 10, as shown in FIG. 3C. After being dispensed onto ring holder 10, the tail gripper 20 grips the tail end 16*a* of the portion of packaging 16, as shown in FIG. 3C, allowing the ring holder to pivot from the stowed position to the active position where the ring holder may be situated, as shown in FIG. 3D, at a front opening of the portion of packaging 16 whereby the packaging 16 may be secured onto the ring holder 10 and subsequently moved over the coiled material 18.

Figure 4B:
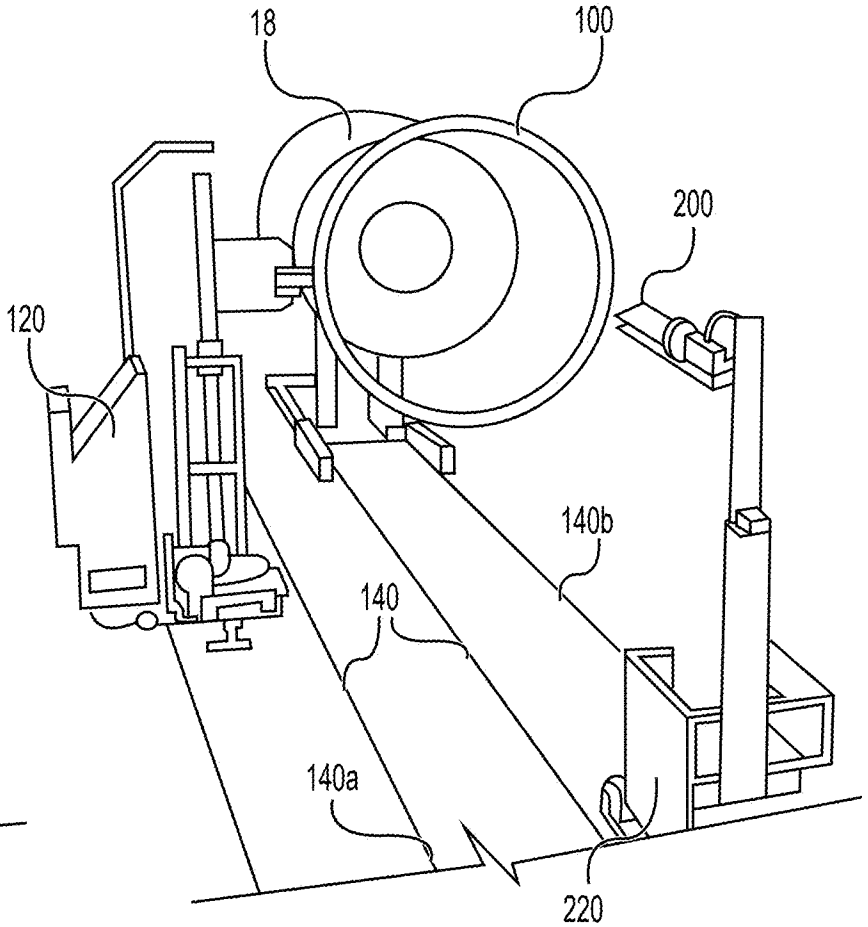
FIG. 4B is an environmental perspective view of a ring holder in a vertical, active position.
Figure 4A:
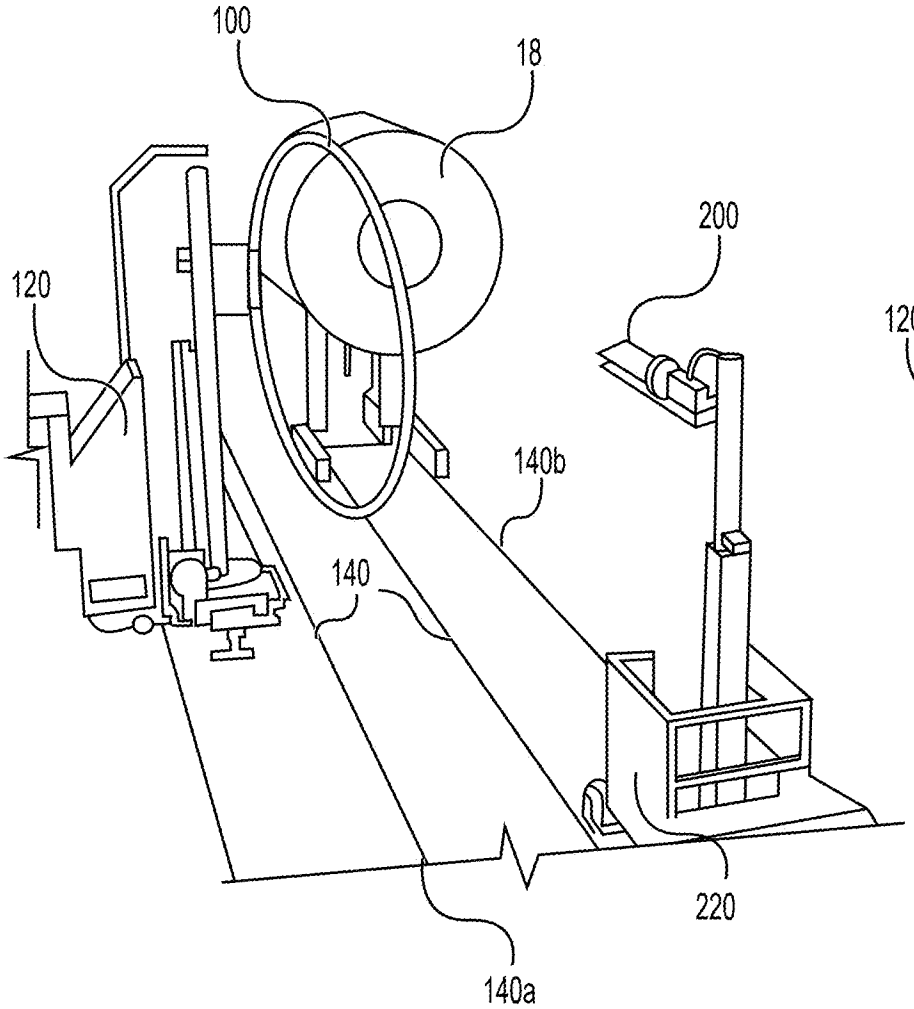
FIG. 4A is an environmental perspective view of a ring holder in a vertical, stowed position.

Turning to FIGS. 4A-B, in another embodiment, ring holder 100 may be vertically oriented in the stowed position, as seen in FIG. 4A, and vertically oriented in the active position, as shown in FIG. 4B. The packaging trolley line 140 may include multiple tracks 140*a*, 140*b*, as shown in the non-limiting example of FIGS. 4A-B. Packaging trolley line 140 may include a first track 140*a* for packaging trolley 120, and a second track 140*b* for rear trolley 220 and tail gripper 200. Although not shown, the packaging dispenser likewise may be vertically oriented for dispensing of packaging material onto the ring holder 100.

Figure 5B:
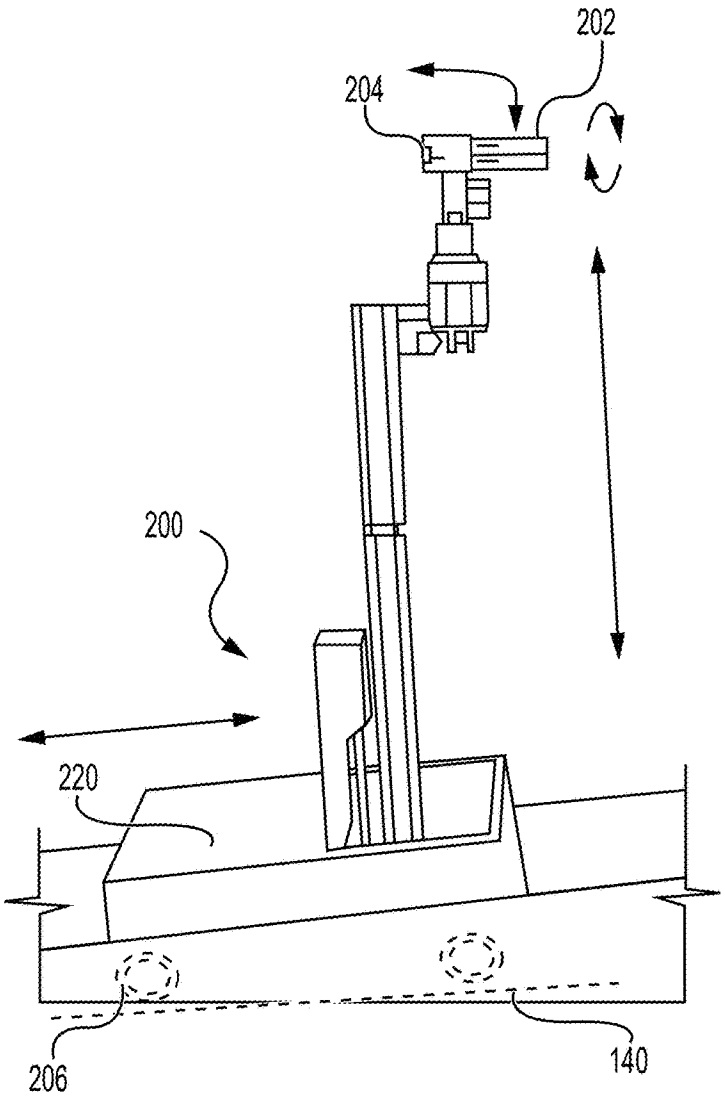
FIG. 5B is a perspective view of a tail gripper in a raised, closed position.
Figure 5A:
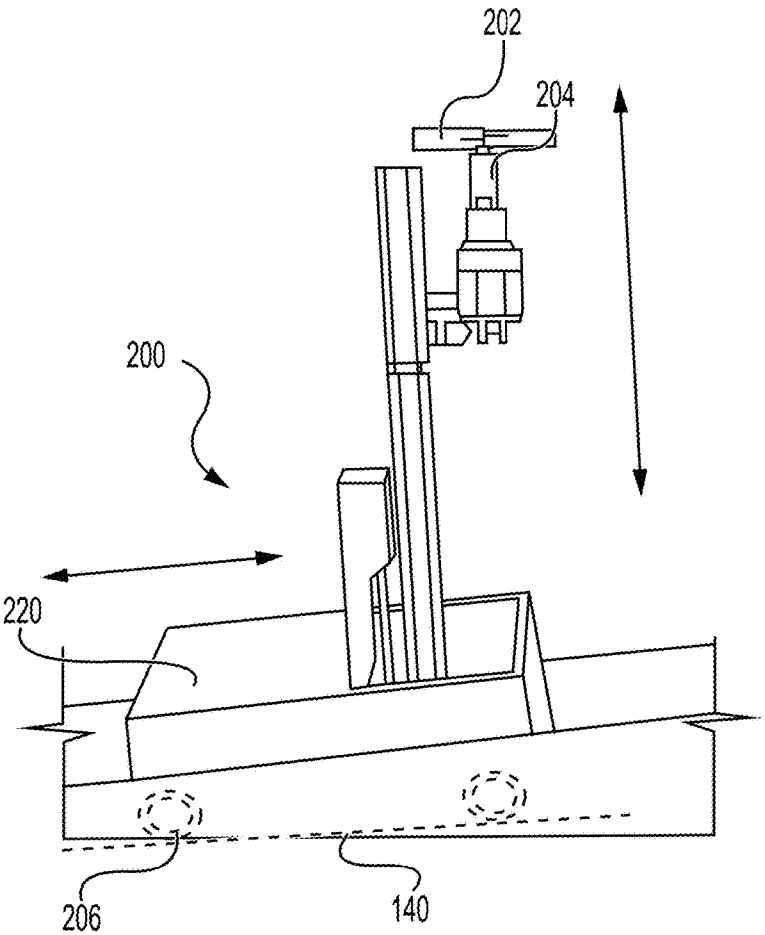
FIG. 5A is a perspective view of a tail gripper in a lowered, open position.

Turning to FIGS. 5A-B, example features of a tail gripper 200 are shown in detail. Tail gripper 200 may include gripping means 202 such as a motorized clamp, clip, clasp, or fastener. Gripping means 202 may be movable by a motorized hinge or the like (not shown) between a lowered, open position of FIG. 5A to a raised, closed position as shown in FIG. 5B. A motor 204 may be included for rotation of gripping means 202 to place the tail end of the packaging into a twisted configuration, and thereby facilitating suctioning through the coiled material. Appropriate carriages, servo motors, gearing and linkages or a pneumatic sliding bed may be provided to move tail gripper 202 vertically between the lowered position of FIG. 5A and the elevated position in FIG. 5B. Rear trolley 220 may include motorized wheels 206 or other means for movement along packaging trolley line 140.

Figure 6B:
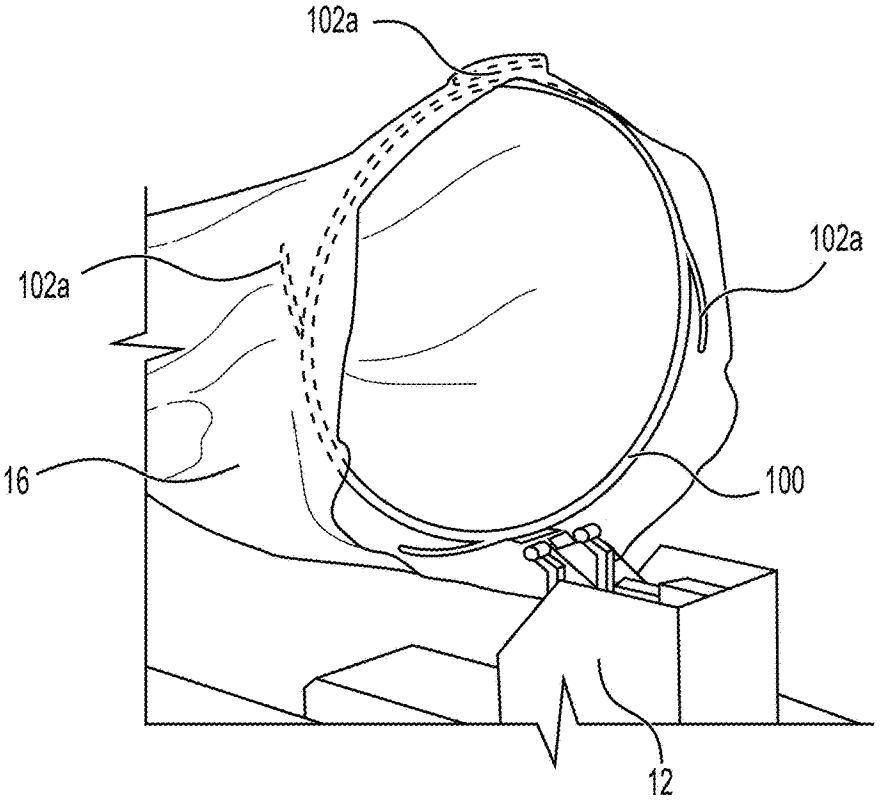
FIG. 6B is an environmental perspective view of a ring holder in an active position with securing means for packaging in an extended position.
Figure 6A:
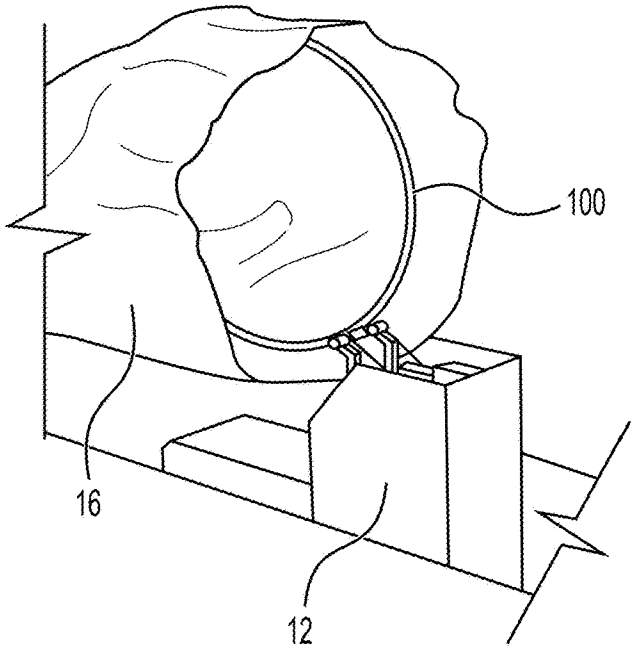
FIG. 6A is an environmental perspective view of a ring holder pivoting from a stowed position to an active position, with securing means for packaging in a retracted position.
Figure 6D:
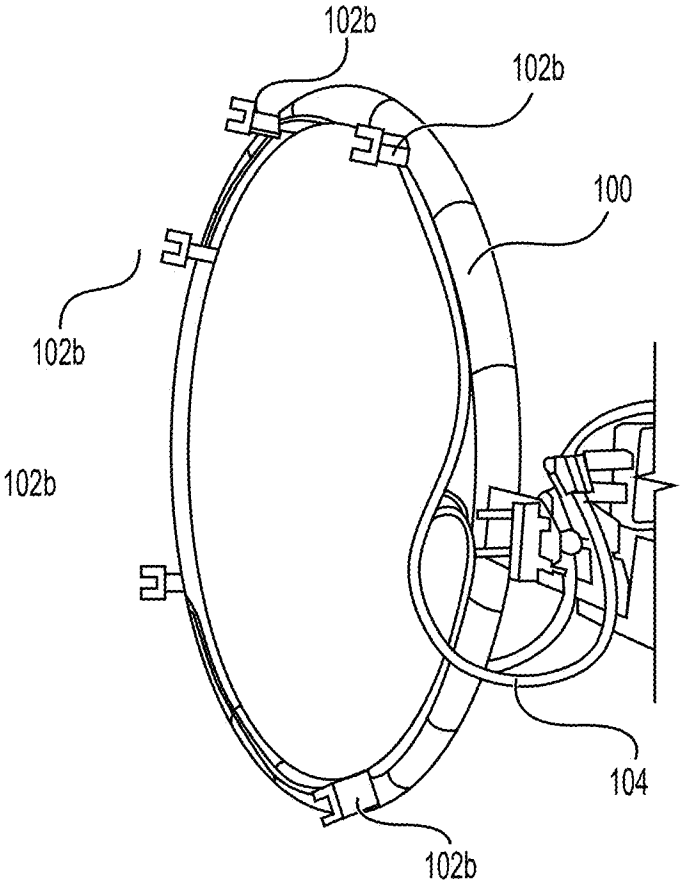
FIG. 6D is a perspective view of a ring holder with pneumatic clamps.
Figure 6C:
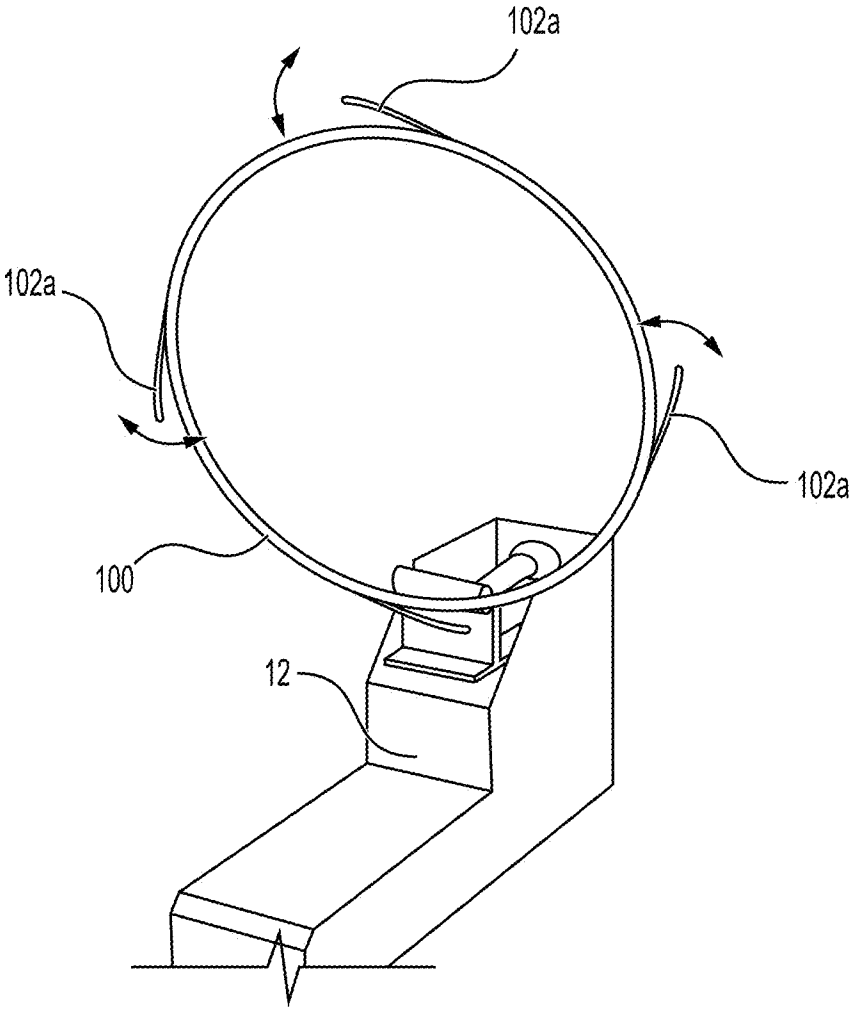
FIG. 6C is a perspective view of a ring holder with packaging securing means extended radially outward.

Referring now to FIGS. 6A-D, example features of a ring holder 100 are shown, including securing means 102*a*, 102*b* for securing packaging 16 onto the ring holder 100. Securing means 102*a* may be, for example, motor driven hinged arms, linear actuators, or spring loaded clips, as examples, that extend radially outward to secure packaging 16 when the securing means 102*a* are in an extended position. As shown in FIG. 6A, securing means 102*a* may be in a retracted position while the ring holder pivots from the stowed to the active position. The pivoting motion of the ring holder 100 serves to widen the front opening of packaging 16 about the periphery of the ring holder 100. Once the ring holder 100 is positioned towards the front opening of the packaging 16, as shown in FIG. 6B, the securing means 102*a* may extend radially outward to secure packaging 16 onto the ring holder 100. Securing means 102*a* may include battery power or may be connected to electrical wiring (not shown) for actuation. FIG. 6C provides another view of securing means 102*a* in an extended position, without the packaging 16 thereon.

Other types of securing means 102*b* may also be used, as seen in FIG. 6D. For example, pneumatic clamps connected by pressure lines 104 to a source of compressed air (not shown). Other examples of securing means 102*b* may include mechanical, electrical, or hydraulic grippers, as well as simple manual hooks, clamps or clasps. Any appropriate amount of securing means 102*a*, 102*b* may be included on ring holder 100, as needed. Securing means 102*a*, 102*b* may be controlled automatically, such as on a timer circuit, or activation through sensing means, but could also be operator-controlled to open and close, as desired.

It is to be understood that the ring holder and method of use thereof for packaging coiled material is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A method for packaging coiled materials comprising:

pivoting a ring holder from a stowed position to an active position, wherein the ring holder is supported by a front trolley on a packaging trolley line;

securing packaging onto the ring holder; and moving the front trolley, ring holder, and packaging secured on the ring holder on the packaging trolley line toward a coiled material, thereby moving the ring holder and packaging secured thereon over the coiled material and covering the coiled material with the packaging.

2. The method for packaging coiled materials according to claim 1, further comprising securing a tail end of the packaging using a tail gripper, wherein the tail gripper is positioned on a rear trolley and is configured to follow the front trolley on the packaging trolley line and the tail end of the packaging is secured prior to moving the front trolley toward the coiled material.

3. The method for packaging coiled materials according to claim 2, further comprising rotating the tail end of the packaging using the tail gripper to place the tail end of the packaging into a twisted configuration.

4. The method for packaging coiled materials according to claim 3, further comprising, applying suction to the tail end of the packaging through a center opening of the coiled material using a vacuum while the tail end of the packaging is in the twisted configuration, and releasing the tail end of the packaging from the tail gripper while the suction is being applied such that the packaging is suctioned through the center opening of the coiled material.

5. The method for packaging coiled materials according to claim 1, further comprising placing the packaging onto the ring holder while the ring holder is in the stowed position.

6. The method for packaging coiled materials as recited in claim 1, further comprising dispensing the packaging from a packaging dispenser, wherein the packaging is fed out from a roll of packaging and is cut to separate and dispense a portion of packaging from the roll of packaging onto the ring holder.

7. The method for packaging coiled materials as recited in claim 6, wherein the portion of packaging is separated and dispensed onto the ring holder while the ring holder is in the stowed position.

8. The method for packaging coiled materials as recited in claim 6, further comprising securing a tail end of the portion of packaging using a tail gripper after the portion of packaging is cut and dispensed onto the ring holder.

9. The method for packaging coiled materials as recited in claim 8, wherein the tail gripper grips the tail end of the portion of packaging while the tail gripper is seated within a seat formed in the packaging dispenser.

10. The method for packaging coiled materials as recited in claim 1, wherein the ring holder is vertical in the stowed position and is vertical in the active position.

11. The method for packaging coiled materials as recited in claim 1, wherein the ring holder is substantially horizontal in the stowed position and is vertical in the active position.

12. The method for packaging coiled materials as recited in claim 1, further comprising releasing the packaging from the ring holder when the ring holder is in a forward position.

13. The method for packaging coiled materials according to claim 12, further comprising retracting the ring holder in a reverse direction along the packaging trolley line over the coiled material after the packaging has been released from the ring holder.

14. A system for packaging coiled materials comprising:

a ring holder configured to securely hold packaging thereon;

a front trolley, wherein the ring holder is mounted on the front trolley and pivotable thereon between a stowed position and an active position;

a tail gripper configured to grip a tail end of packaging; and a rear trolley, wherein the tail gripper is positioned on the rear trolley and the rear trolley is configured to follow the front trolley on a packaging trolley line.

15. The system for packaging coiled materials as recited in claim 14, wherein the ring holder is pivotable from a substantially horizontal position to a vertical position.

16. The system for packaging coiled materials as recited in claim 15, further comprising a roll of packaging on a packaging dispenser, wherein the roll of packaging and packaging dispenser are oriented to dispense the packaging horizontally.

17. The system for packaging coiled materials as recited in claim 16, wherein the packaging dispenser includes dispensing rollers configured to dispense packaging onto the ring holder.

18. The system for packaging coiled materials as recited in claim 16, wherein tail gripper and packaging dispenser are configured to rest within a seat formed in the packaging dispenser.

19. The system for packaging coiled materials as recited in claim 16, wherein the packaging dispenser includes dispensing rollers configured to automatically dispense packaging from the packaging dispenser.

20. The system for packaging coiled materials as recited in claim 19, wherein the packaging dispenser includes a cutter configured to automatically cut a portion of packaging from the packaging dispenser.

* * * * *